US009480374B2

(12) United States Patent
Li et al.

(10) Patent No.: US 9,480,374 B2
(45) Date of Patent: Nov. 1, 2016

(54) AGITATOR ASSEMBLY FOR VACUUM CLEANER

(71) Applicant: BISSELL Homecare, Inc., Grand Rapids, MI (US)

(72) Inventors: Feng Chun Li, Shenzhen (CN); Aaron P. Griffith, Grand Rapids, MI (US); Matthew T. Acker, Grand Rapids, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 419 days.

(21) Appl. No.: 14/081,063

(22) Filed: Nov. 15, 2013

(65) Prior Publication Data

US 2014/0143978 A1 May 29, 2014

Related U.S. Application Data

(60) Provisional application No. 61/729,843, filed on Nov. 26, 2012.

(51) Int. Cl.
*A47L 5/30* (2006.01)
*A47L 9/04* (2006.01)

(52) U.S. Cl.
CPC ..... *A47L 5/30* (2013.01); *A47L 9/0444* (2013.01); *A47L 9/0455* (2013.01); *A47L 9/0477* (2013.01)

(58) Field of Classification Search
None
See application file for complete search history.

(56) References Cited

U.S. PATENT DOCUMENTS

| | | | | |
|---|---|---|---|---|
| 4,403,372 | A | 9/1983 | Keane et al. | |
| 4,847,944 | A | 7/1989 | Lackner | |
| 5,193,243 | A * | 3/1993 | Stegens | A47L 9/0455 15/179 |
| 5,465,451 | A | 11/1995 | Stegens | |
| 6,367,120 | B2 | 4/2002 | Beauchamp | |
| 6,892,420 | B1 * | 5/2005 | Haan | A46B 13/001 15/339 |
| 2006/0042042 | A1 * | 3/2006 | Mertes | A47L 9/0477 15/392 |
| 2009/0229075 | A1 | 9/2009 | Eriksson | |
| 2014/0259522 | A1 | 9/2014 | Kasper et al. | |

OTHER PUBLICATIONS

David J. Evans, Combined Search and Examination Report under Sections 17 and 18(4), Aug. 6, 2015, 3 pages, South Wales.
Rhodri Evans, Search Report under Section 17(5), Feb. 20, 2014, 3 pages, South Wales, United Kingdom.

* cited by examiner

*Primary Examiner* — Joseph J Hail
*Assistant Examiner* — Brian Keller
(74) *Attorney, Agent, or Firm* — McGarry Bair PC

(57) ABSTRACT

A vacuum cleaner comprises an agitator assembly mounted within an agitator cavity and a hair wrap inhibitor provided on the agitator assembly that is configured to prevent hair and debris from migrating into the agitator bearings and jamming or otherwise damaging the agitator assembly during operation. The hair wrap inhibitor can be a hair blocking rib extending from an end cap of the agitator assembly.

20 Claims, 8 Drawing Sheets

AGITATOR ASSEMBLY FOR VACUUM CLEANER

CROSS-REFERENCE TO RELATED APPLICATION

This application claims the benefit of U.S. Provisional Patent Application No. 61/729,843, filed Nov. 26, 2012, which is incorporated herein by reference in its entirety.

BACKGROUND OF THE INVENTION

Vacuum cleaners typically employ an agitator assembly that is configured to release dust, hair and debris from a surface to be cleaned. The dust, etc. is transported via a working airflow to a downstream separator that separates the dust, etc. from the working airflow and deposits the dust, etc. in a downstream dirt collector.

Vacuum cleaner agitators typically comprise an agitator dowel that is rotatably mounted within a housing and configured to rotate about bearing assemblies at each end thereof. Agitators can be driven by a belt operably connecting a drive pulley on a vacuum motor/fan shaft to a driven pulley on the agitator body. Alternatively, a dedicated agitator drive motor can be configured to selectively drive the agitator independently of the vacuum motor/fan assembly.

BRIEF SUMMARY OF THE INVENTION

According to one embodiment of the invention, a vacuum cleaner comprises a housing having an agitator cavity and a suction nozzle, a suction source in fluid communication with the suction nozzle, and an agitator assembly mounted in the agitator cavity for rotation about an axis. The agitator assembly comprises a dowel provided with a plurality of bristles and having at least one end defining a bearing cavity, a shaft along the axis, an end cap received on the shaft to overlie the bearing cavity and forming at least one gap relative to the at least one end, and a hair blocking rib extending from the end cap and inhibiting the migration of hair through the at least one gap and into the bearing cavity.

DESCRIPTION OF EMBODIMENTS OF THE INVENTION

The invention relates to an agitator assembly for a floor care appliance, such as a vacuum cleaner, which may include vacuum cleaners capable of fluid extraction and/or distribution, such as an extractor. For purposes of description related to the figures, the terms "upper," "lower," "right," "left," "rear," "front," "vertical," "horizontal," and derivatives thereof shall relate to the invention as oriented in FIG. 1 from the perspective of a user behind the vacuum cleaner, which defines the rear of the vacuum cleaner. However, it is to be understood that the invention may assume various alternative orientations, except where expressly specified to the contrary.

Figure 1:
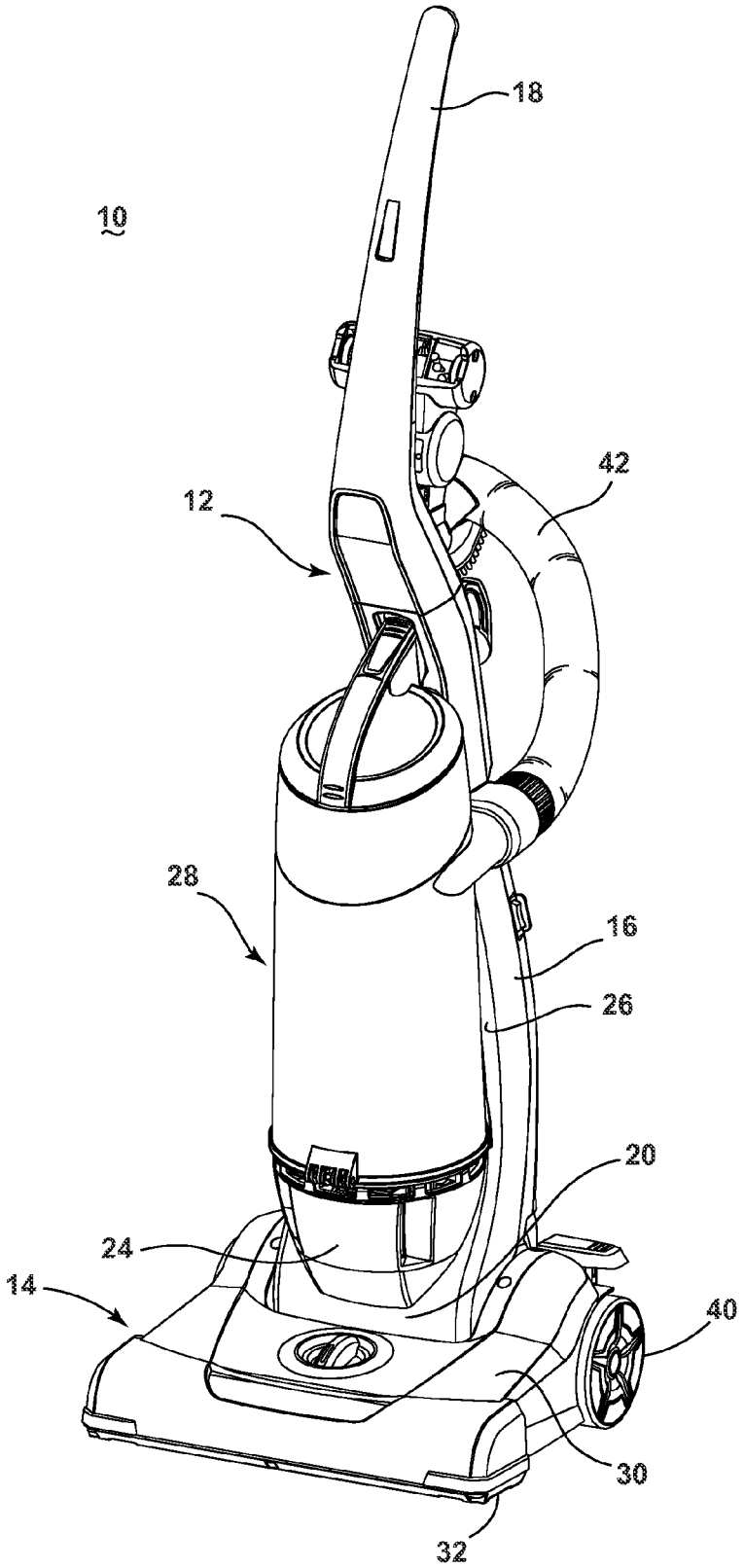
FIG. 1 is a front perspective view of a vacuum cleaner according to a first embodiment of the invention.

FIG. 1 is a front perspective view of an upright vacuum cleaner 10 according to a first embodiment of the invention comprising an upright handle assembly 12 pivotally mounted to a foot assembly 14. The handle assembly 12 further comprises a primary support section 16 with a grip 18 on one end to facilitate movement by a user. A motor cavity 20 is formed at an opposite end of the handle assembly 12 to contain a conventional suction source such as a vacuum fan/motor assembly 22 (FIG. 2) therein. The handle assembly 12 pivots relative to the foot assembly 14 about a pivot axis. A post-motor filter housing 24 is formed above the motor cavity 20 and is in fluid communication with the vacuum fan/motor assembly 22, and receives a filter media (not shown) for filtering air exhausted from the vacuum fan/motor assembly 22 before the air exits the vacuum cleaner 10. A mounting section 26 on the primary support section 16 of the handle assembly 12 receives a separation/collection module 28 for separating and collecting dirt and other contaminants from a dirt-containing working airstream.

Figure 2:
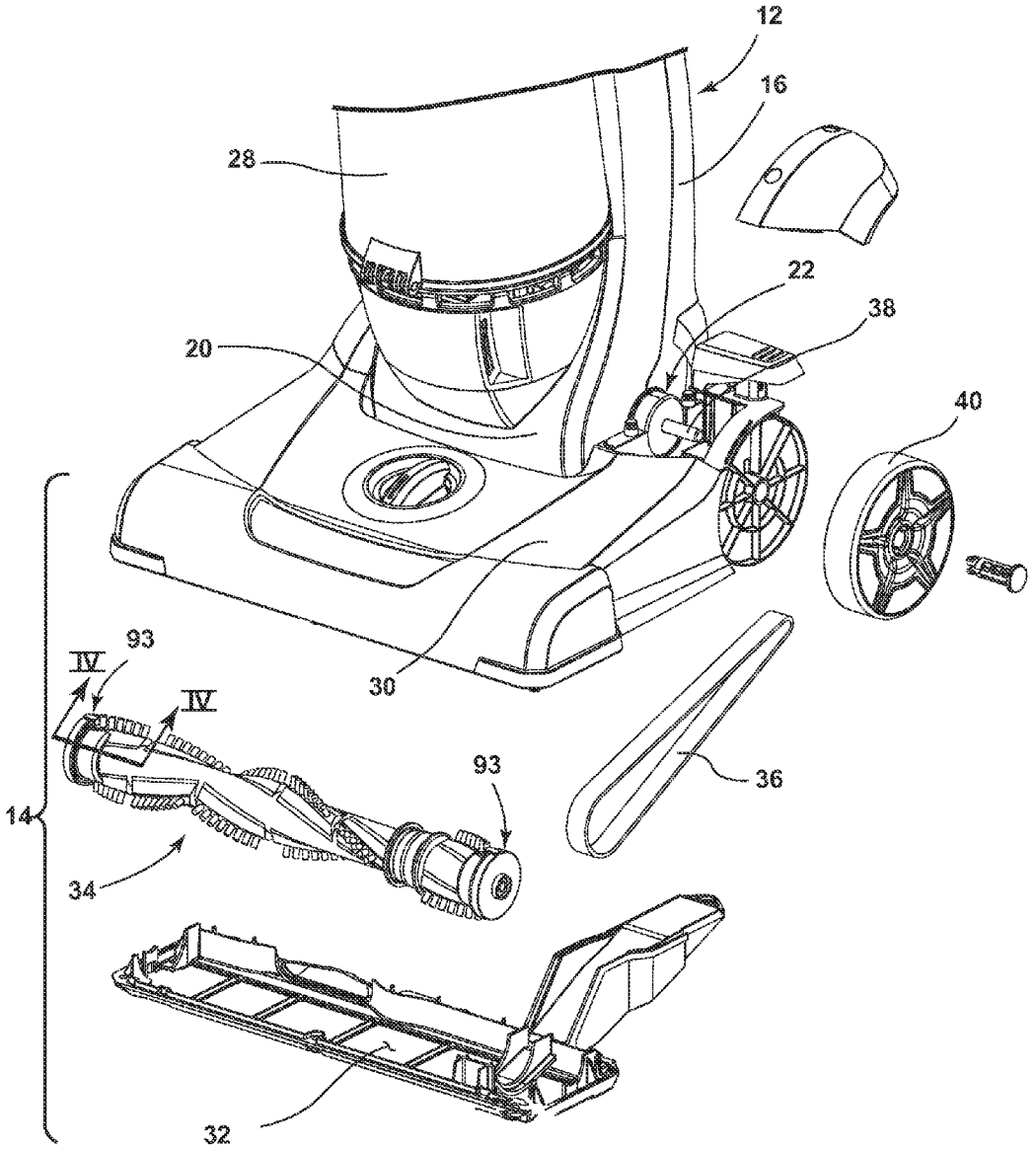
FIG. 2 is a partial exploded perspective view of a foot assembly of the vacuum cleaner of FIG. 1.

FIG. 2 is a partial exploded perspective view of a foot assembly of the vacuum cleaner of FIG. 1. The foot assembly 14 comprises a housing 30 with a suction nozzle 32 formed at a lower surface thereof and that is in fluid communication with the vacuum fan/motor assembly 22. An agitator assembly 34 is positioned within the housing 30 adjacent the suction nozzle 32 and operably connected to the vacuum fan/motor assembly 22 within the motor cavity 20. The vacuum fan/motor assembly 22 is oriented transversely within the motor cavity 20 and comprises a motor shaft 38 which is oriented substantially parallel to the surface to be cleaned and protrudes from the motor cavity 20 into a rear portion of the housing 30. A stretch belt 36 operably connects the motor shaft 38 to the agitator assembly 34 for transmitting rotational motion of the motor shaft 38 to the agitator assembly 34. Alternatively, the agitator assembly can be operably connected to a dedicated agitator motor within the housing 30.

Referring to FIG. 1, rear wheels 40 are secured to a rearward portion of the housing 30 and front wheels (not shown) are secured to a forward portion of the foot assembly 14 for moving the foot assembly 14 over a surface to be cleaned. When the separation/collection module 28 is received in the mounting section 26, the separation/collection module 28 is in fluid communication with, and fluidly positioned between, the suction nozzle 32 and the vacuum fan/motor assembly 22 within the motor cavity 20. At least a portion of the working air pathway between the suction nozzle 32 and the separation/collection module 28 can be formed by a vacuum hose 42 that can be selectively disconnected from fluid communication with the suction nozzle 32 for above-the-floor cleaning.

Figure 3:
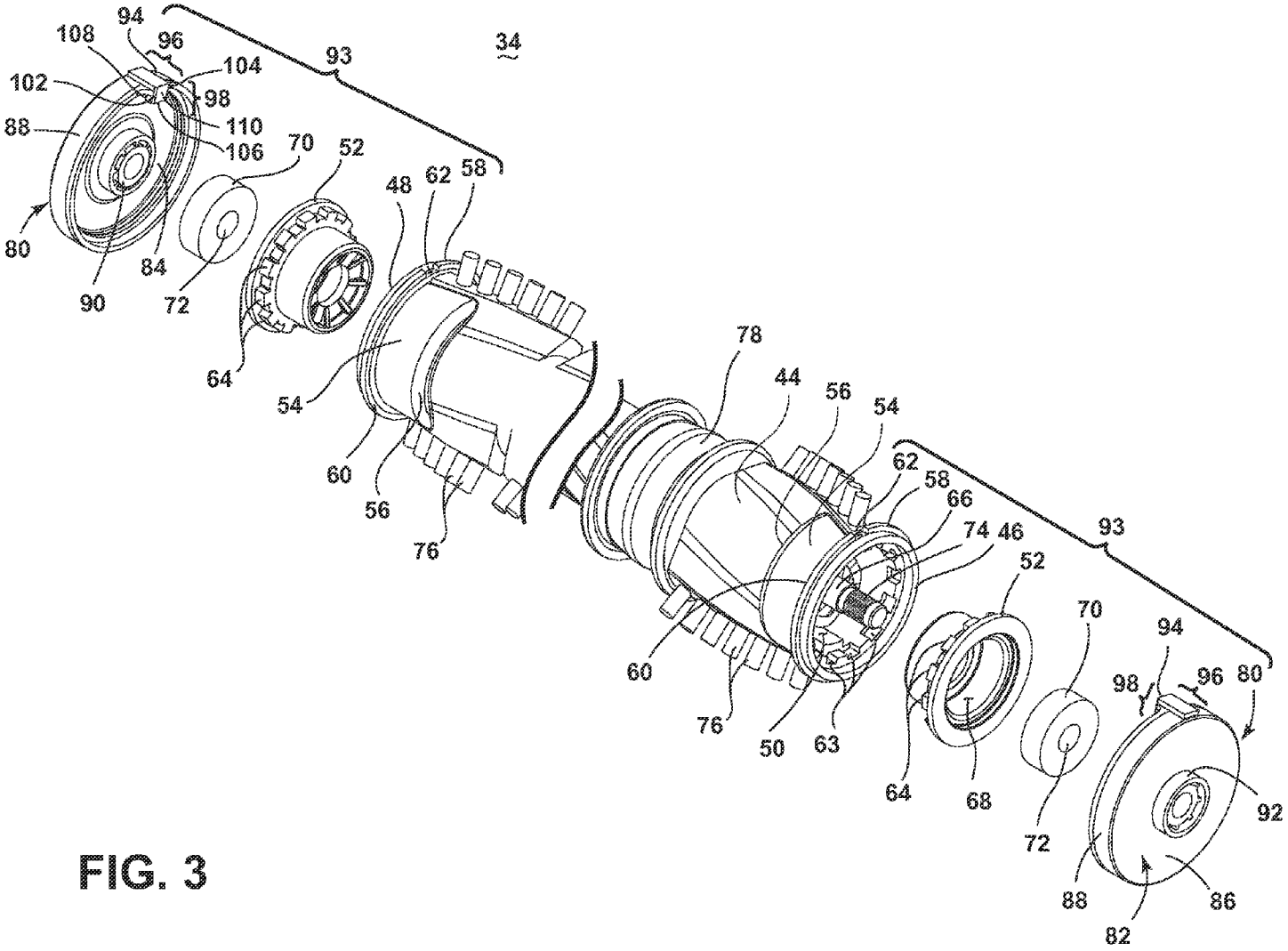
FIG. 3 is a partial exploded perspective view of an agitator assembly with a hair wrap inhibitor of the vacuum cleaner of FIG. 2.

FIG. 3 is an exploded view of the agitator assembly 34, which can comprise a brush dowel 44 with a first recessed end 46 and a second recessed end 48, each defining a cavity 50 that is configured to receive a bearing holder 52 therein. The recessed ends 46, 48 of the dowel 44 are each defined by an outwardly stepped cylindrical wall 54 having a larger diameter than the portion of dowel 44 immediately adjacent to the recessed ends 46, 48, thereby forming a first barrier wall 56 that projects radially outwardly from the dowel 44 and is configured to obstruct hair and debris from migrating along the dowel 44 towards the bearing holder 52 at each end thereof.

A flange 58 protrudes radially outwardly from the each end 46, 48 of the dowel 44. The flange 58 defines a second barrier wall 60 that is configured to further obstruct hair and debris ingress into the bearing holder 52. The flange 58 further comprises a radial slot 62, which defines an opening for receiving an additional hair wrap inhibitor feature that will be described hereinafter.

Retainer features 63 inside the first and second recessed ends 46, 48 are configured to mate with corresponding retainer features 64 on the bearing holders 52 to secure the bearing holders 52 within the recessed ends 46, 48. For exemplary purposes, the retainer features 63, 64 have been illustrated as complimentary teeth that are arranged around the outer surface of the bearing holders 52 and around the mating inner surface of the recessed ends 46, 48, and which can be intermeshed and press fit together to secure the bearing holders 52 within the recessed ends 46, 48. Additionally, the bearing holders 52 can be fastened to the dowel 44 by any variety of manufacturing processes or combinations thereof, including adhesive, welding, press-fit or mechanical fasteners, for example.

An agitator shaft 66 extends through the center of the dowel 44 along the longitudinal axis of the agitator assembly 34. The brush dowel 44 and bearing holders 52 can be fixed together and rotatably mounted about the agitator shaft 66. Each bearing holder 52 includes a pocket 68 for receiving a bearing 70 therein. The bearing 70 includes a central aperture 72, which is configured to be press fit onto the shaft 66, inboard from a stepped, knurled end 74 thereof. A plurality of bristle tufts 76, each including a plurality of bristles, protrude from the outer periphery of dowel 44. A driven pulley 78 is formed on a portion of the dowel 44, near the first recessed end 46.

An end cap 80 can be mounted to each end of the shaft 66 and thus the end caps 80 define the ends of the agitator assembly 34. Each end cap 80 comprises an end wall 82 with an inner surface 84 and an outer surface 86, and further comprises a rim 88 on the periphery of the end wall 82 that defines the perimeter of the end cap 80 and that extends inwardly from the end wall 82. An internal collar 90 protrudes from the inner surface 84 and can be press fit onto the stepped, knurled end 74 of the shaft 66. An outer projection 92 protrudes from the outer surface 86 and can be received in a corresponding mounting feature (not shown) within the housing 30 of the foot assembly 14 (FIG. 2). Although not shown in the figures, the outer projection 92 can be keyed to the corresponding mounting feature in the housing 30 to prevent rotation of the end cap 80 relative to the housing 30, during operation of the agitator assembly 34.

Figure 4:
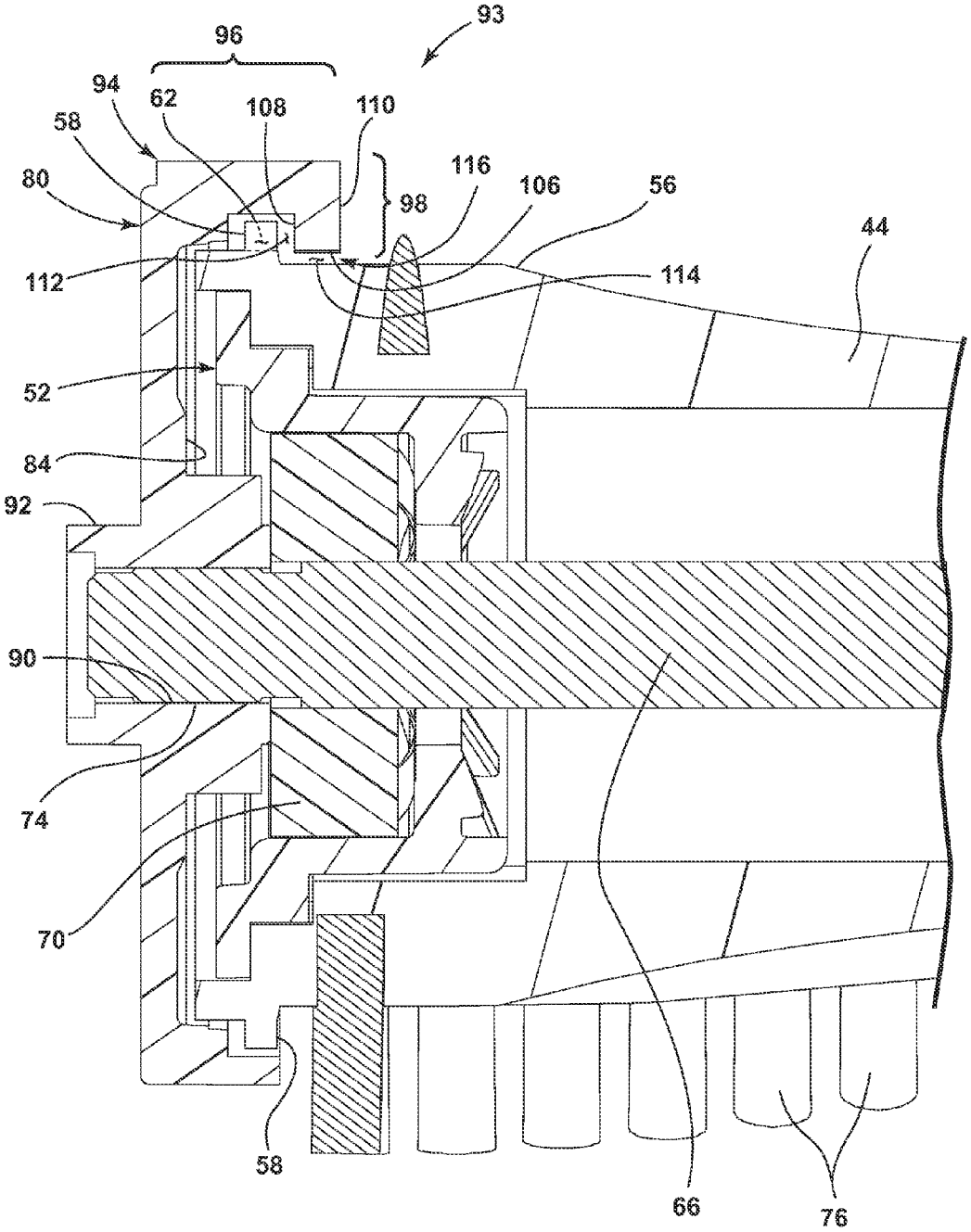
FIG. 4 is a partial sectional view of the agitator assembly, taken along line IV-IV of FIG. 2.

At least one hair wrap inhibitor 93 can be provided on the agitator assembly 34. For exemplary purposes, the hair wrap inhibitor 93 is illustrated as a hair blocking rib 94 formed on the rim 88 of each end cap 80 and the slotted flange 58 on the dowel 44. The hair blocking rib 94 comprises an L-shaped member having an inwardly-extending support portion 96 and a downwardly-extending tab portion 98. The support portion 96 can extend along the rim 88 and terminates at the tab portion 98, which protrudes radially inwardly from the rim 88, towards the longitudinal axis of the agitator assembly 34. The tab portion 98 can comprise a front face 102, a rear face 104, a bottom face 106 adjacent to but spaced from the outer surface of the dowel 44, an inner face 108 and an outer face 110. As best shown in FIG. 4, the inner face 108 is spaced apart from the inner surface 84 of the end cap 80. Optionally, additional hair blocking ribs 94 can be formed on the end caps 80. In that case, the flange 58 can comprise additional complimentary radial slots (not shown) that are spaced around the perimeter of the dowel 44 to accommodate the additional hair blocking ribs (not shown). Alternatively, only one of the end caps 80 can be provided with one or more hair blocking rib(s) 94.

To assemble the end cap 80 onto the shaft 66, the central axes of the end cap 80 and shaft 66 are aligned and the tab portion 98 is aligned with the radial slot 62. The internal collar 90 can then be pressed onto the knurled end 74 of the shaft 66. As the end cap 80 is pushed inwardly onto the shaft 66, the tab portion 98 passes through the radial slot 62 in the flange 58.

Referring to FIG. 4, when the end cap 80 is fully seated on the shaft 66, the inner face 108 of the tab portion 98 lies adjacent to the inboard side of the flange 58 with a slight horizontal gap 112 therebetween so that the flange 58 can move freely, relative to the tab portion 98, as the dowel 44 rotates during operation. Likewise, a slight vertical gap 114 between the bottom face 106 of the tab portion 98 and the outer surface of the dowel 44 provides clearance between the dowel 44 and the hair blocking rib 94, which ensures that the dowel 44 can rotate freely relative to the tab portion 98. The gaps 112, 114 can be configured to account for dimensional variation and tolerance stack-ups between the adjacent parts and can generally comprise about 1 mm and more preferably not less than 1 mm. Accordingly, when the end cap 80 is fully seated on the shaft 66, the gaps 112, 114 form an overlapping labyrinth 116 between adjacent surfaces of the tab portion 98, including the outer face 110, bottom face 106, inner face 108, the dowel 44 and the flange 58 to shield the bearing 70 and block ingress of dust, hair and debris into the bearing holder 52.

In operation, referring to FIGS. 2-3, when the vacuum cleaner 10 is energized, the spinning motor shaft 38 of the vacuum motor/fan assembly 22 rotates the dowel 44 via the stretch belt 36 that is operably connected therebetween. As the dowel 44 rotates about the shaft 66 on the bearings 70, which are mounted in the ends thereof, the bristle tufts 76 sweep across the cleaning surface and release and propel dust, hair and debris into the working air flow generated by the vacuum motor/fan assembly 22, which carries said debris through the working air path of the vacuum cleaner 10.

Although most of the dust, hair and debris are drawn into the working air path of the vacuum cleaner 10 by the working airflow and into the downstream separation/collection module 28, which separates and collects the dirt therein, some amount of hair and debris strands, such as thread or string, for example, can become wrapped around the dowel 44. Over time, the hair and debris can accumulate on the dowel 44 and can eventually migrate towards the ends of the agitator assembly 34. The first barrier wall 56 provides a radial step, which initially obstructs hair and debris from migrating outwardly towards the bearings 70. However, if the amount of hair and debris accumulates to a level that exceeds the height of the first barrier wall 56, for example, or if the hair wraps around the stepped cylindrical wall 54, the hair and debris can continue to migrate towards the bearings 70. In that case, the hair wrap inhibitor 93 provides a second obstruction, which blocks the hair and debris from entering the bearing holders 52. The accumulated hair and debris rotate together with the dowel 44 relative to the hair blocking rib 94. The accumulated hair and debris migrates outwardly towards the bearing 70, and encounters the stationary tab portion 98 of the hair blocking rib 94, which blocks the hair and debris from migrating along the rotating dowel 44 and prevents the hair and debris from passing through the labyrinth 116 defined between the blocking rib 94 and flange 58, thereby protecting the bearing 70 from hair and debris ingress. The labyrinth 116 itself provides a third obstruction for preventing hair and debris from entering the bearing holder 52 and interfering with the bearing 70.

Figure 5:
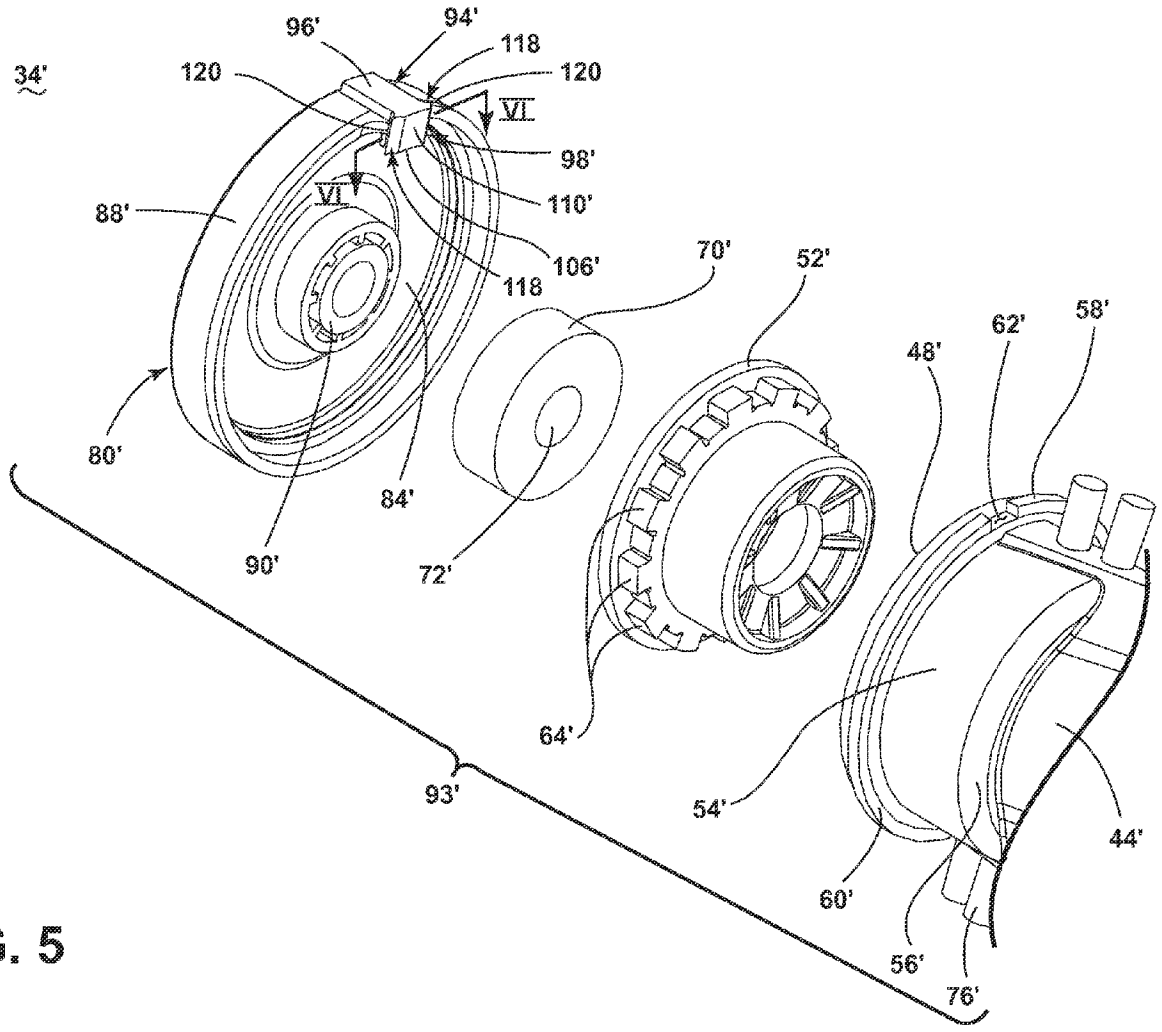
FIG. 5 is a partial exploded perspective view of an agitator assembly with a hair wrap inhibitor according to a second embodiment of the invention.

FIG. 5 is a partial perspective view of an agitator assembly 34' comprising a hair wrap inhibitor 93' according to a second embodiment of the invention, in which like elements are identified with the same reference numerals bearing a prime (') symbol. The second embodiment is substantially similar to the first embodiment shown in FIGS. 3 and 4, except for the hair wrap inhibitor 93'. In the second embodiment, the tab portion 98' of the hair wrap inhibitor 93' can comprise a cutting blade 118 configured to cut hair and debris off of the dowel 44' when the hair and debris migrate outwardly on the dowel 44' and contact the cutting blade 118 during operation. The hair and debris that is severed from the dowel 44' by the cutting blade 118 can be entrained in the working airflow and ingested through the suction nozzle 32 (FIG. 1) and into the working air path.

The cutting blade 118 can be formed integrally with the end cap 80'. For exemplary purposes, the cutting blade 118 can comprise the same plastic material used to form the end cap 80', such as nylon or polypropylene, for example, and can be formed by a manufacturing process such as injection molding, for example. Alternatively, the cutting blade 118 can be formed separately from the end cap 80' and fastened thereto by a secondary manufacturing process such as insert molding, heat staking, ultrasonic welding or by adhesive, for example.

Figure 6:
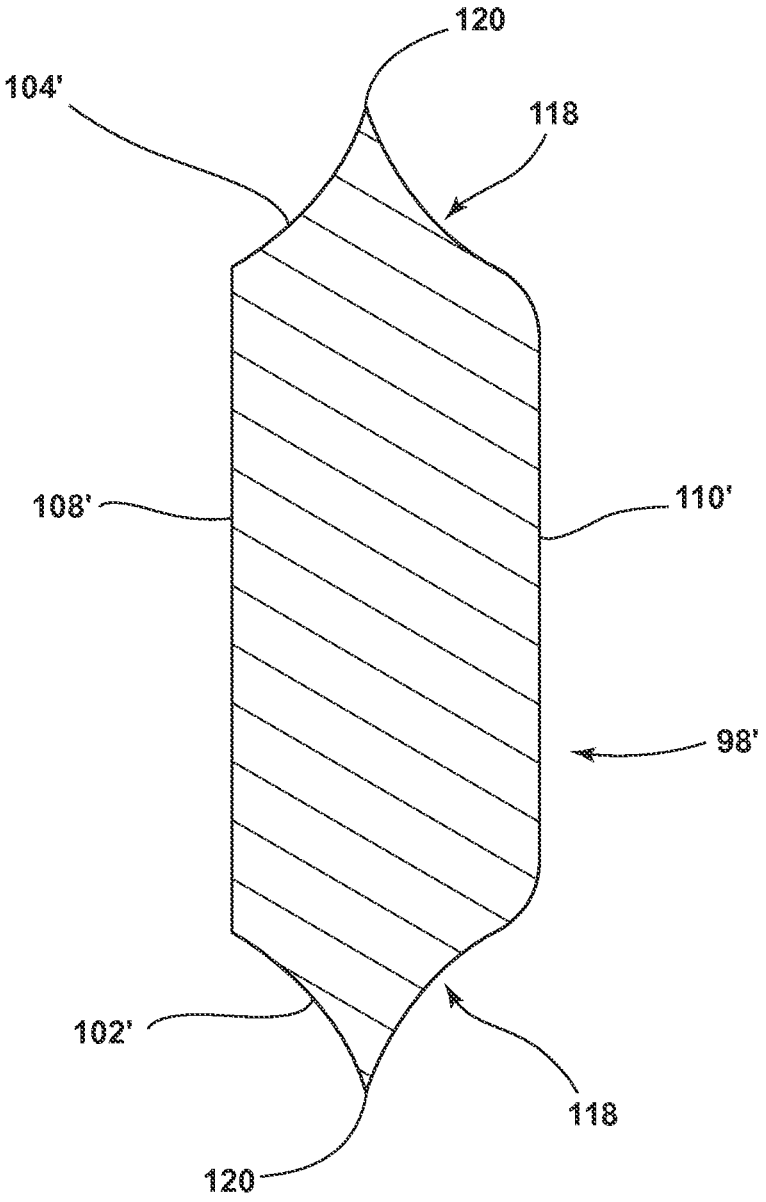
FIG. 6 is a sectional view of the end cap of FIG. 5, taken along line VI-VI.

The cutting blade 118 can be formed along any portion or all of the front face 102', the bottom face 106', the rear face 104', or any combination thereof. Referring to FIG. 6, for exemplary purposes, the hair cutting blade 118 has been illustrated as having a sharp edge 120 formed on the front face 102' and the rear face 104' of the tab portion 98' so that the end cap 80' can be used interchangeably on both ends of the dowel 44'. In this configuration, a cutting blade 118 is always oriented to oppose the direction of dowel 44' rotation, regardless of which end of the shaft 66' the end cap 80' is mounted to. Alternatively, the cutting blade 118 can be formed along a single face of the tab portion 98' and a dedicated right and left end cap 80' can be configured for mounting on the corresponding right and left ends of the agitator assembly 34'.

Although the cutting blade 118 has been illustrated in the figures as a simple rectangular rib-like structure having substantially sharp edge 120 along at least a portion of the perimeter, the cutting blade 118 can also comprise alternative structures, such as angled, contoured, serrated, or undulating edges that are configured to enhance hair and debris cutting performance, similar to a knife blade, for example. Furthermore, although only a single hair wrap inhibitor 93' has been shown on the end cap 80', additional hair wrap inhibitors 93' having cutting blades 118 can be formed around the rim 88' of the end cap 80'. However, in this case, additional corresponding radial slots (not shown) must be provided in the flange 58 to accommodate the additional cutting blades (not shown).

In operation, the dowel 44' rotates as previously described for the first embodiment, and the bristle tufts 76' sweep across the cleaning surface and release and propel dust, hair and debris into the working air flow. Over time, the hair and debris accumulates on the dowel 44' and can eventually migrate towards the ends of the agitator assembly 34'. As the hair and debris migrates outwardly along the dowel 44', rotating therewith, the hair and debris contacts the sharp edge 120 of the cutting blade 118, which severs the portion of hair and debris interfering with the cutting blade 118 and releases the cut hair/debris into the working air flow. The cutting blade 118 severs the hair and debris from the agitator assembly 34 for removal via the working airflow and thus prevents hair and debris from passing through the labyrinth 116 (FIG. 4) formed between the cutting blade 118 and flange 58', protecting the bearing 70' from hair and debris ingress. In the second embodiment, the first barrier wall 56' and the labyrinth 116 also provides obstructions to the migration of hair and debris as described above for the first embodiment.

Figure 7:
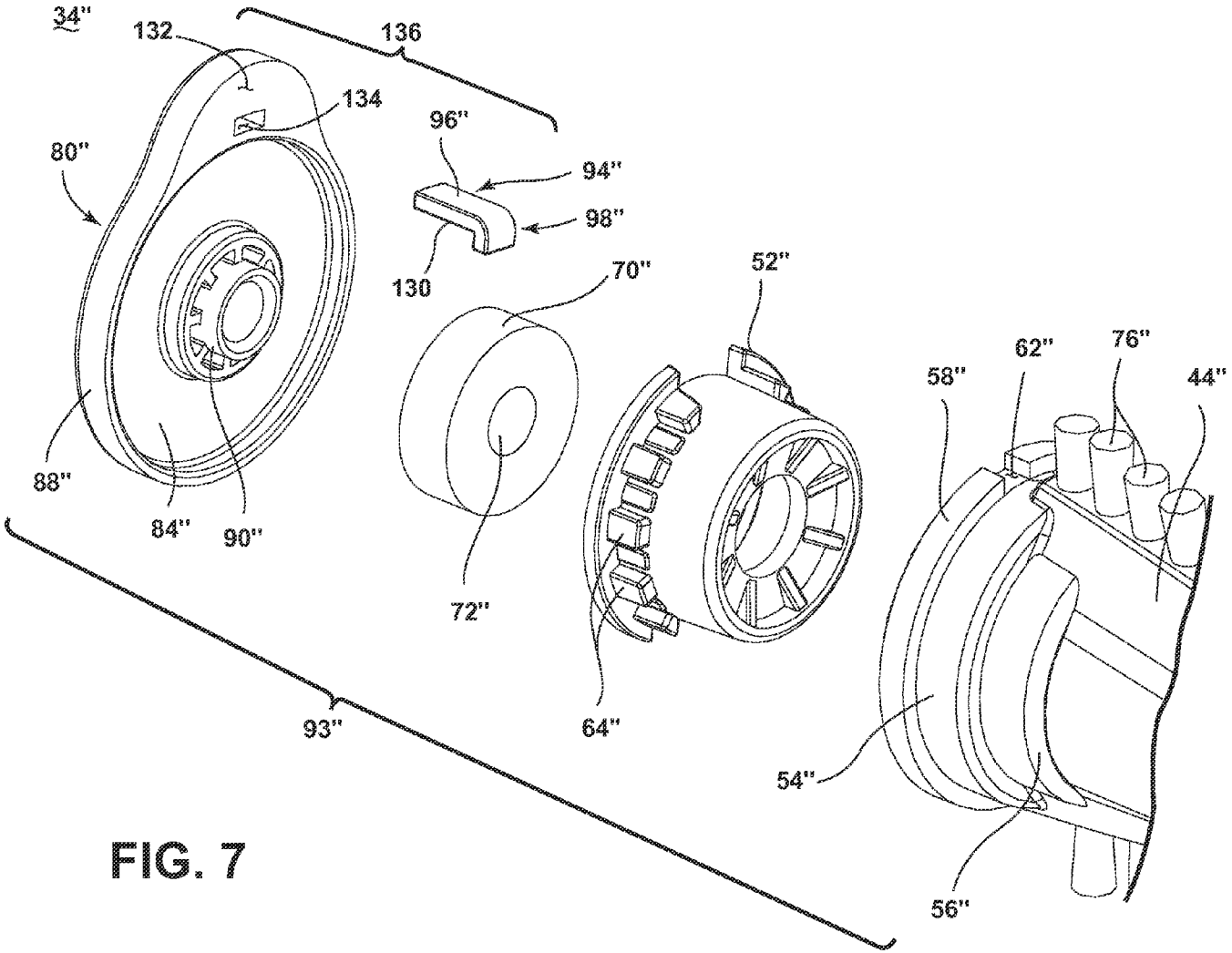
FIG. 7 is a partial exploded perspective view of an agitator assembly with a hair wrap inhibitor according to a third embodiment of the invention.

FIG. 7 is a partial exploded perspective view of an agitator assembly 34" that includes a hair wrap inhibitor 93" according to a third embodiment of the invention, in which like elements are identified with the same reference numerals bearing a double prime (") symbol. The third embodiment is substantially similar to the first embodiment shown in FIGS. 3 and 4, except for the configuration of the end cap 80" and the hair blocking rib 94". In the third embodiment, the hair blocking rib 94" can comprise an insert 130 that is formed separately from the end cap 80" and out of a different material than the end cap 80". For exemplary purposes, the insert 130 can be formed of a metal material, such as steel, for example and the end cap 80" can be formed of a thermoplastic polymer material, for example. The insert 130 can be fastened to the end cap 80" by various manufacturing methods, such as insert molding, heat staking, ultrasonic welding, or by adhesive, for example. Forming the insert 130 out of a metal material may be preferred because metal generally is more durable and less prone to deformation compared to other materials, such as plastic. In addition, metal can resist abrasion and heat caused by friction between hair and the insert 130 during operation. Also, metal can offer improved hair cutting performance and is well suited for assembly using a variety of manufacturing methods compared to other materials, such as plastic.

The end cap 80" comprises a tab 132 that protrudes outwardly from the rim 88". The tab 132 includes a hole 134 therein for receiving one end of the insert 130. The insert 130 comprises a bent, L-shaped strip including the support portion 96" and the tab portion 98" that is bent substantially perpendicular to the support portion 96". The free end of the support portion 96" is configured to be fixedly received within the hole 134. Although not shown, the free end of the support portion 96" can further comprise retention features, such as barbs, for example.

Figure 8:
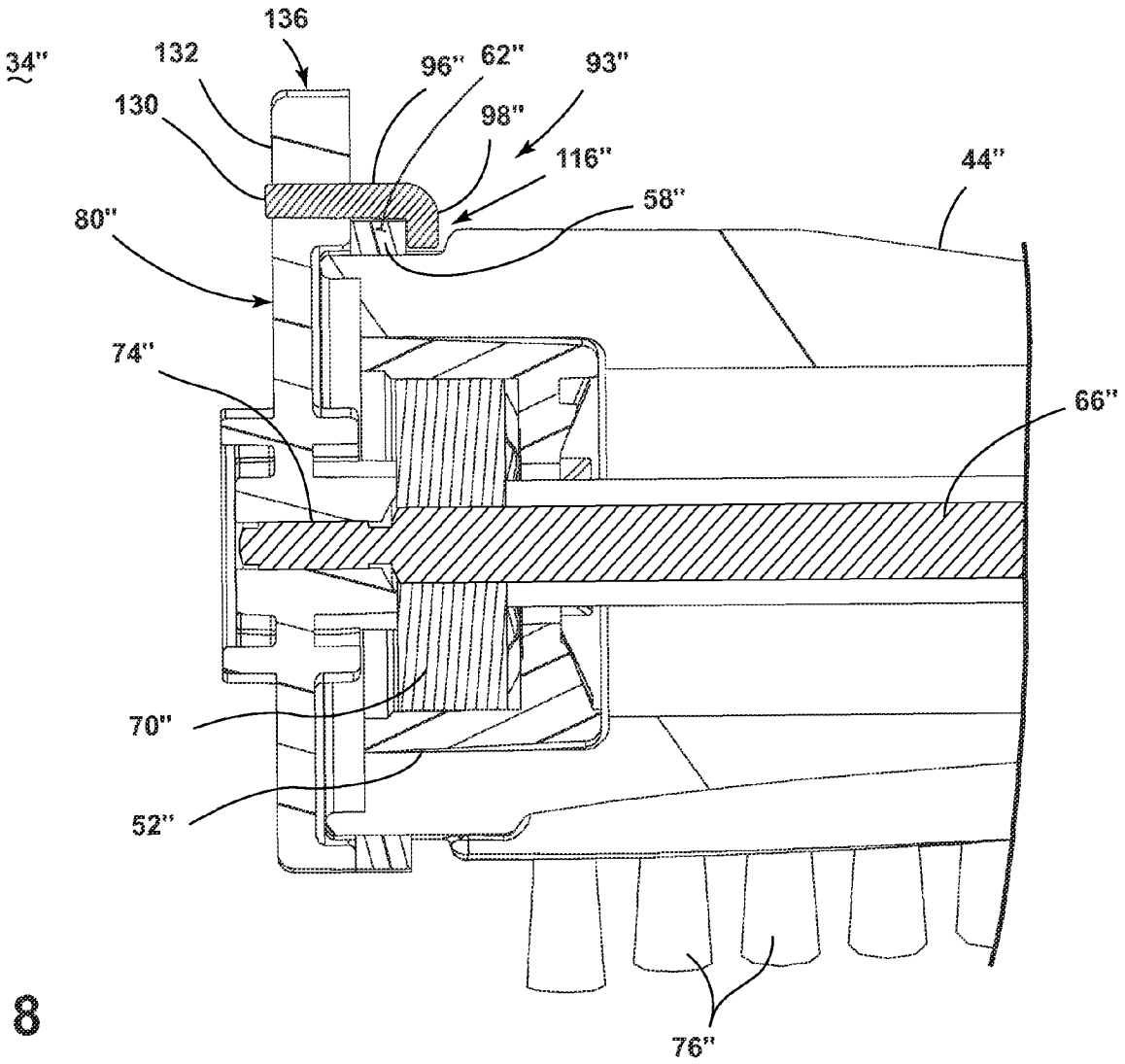
FIG. 8 is a partial sectional view of the agitator assembly of FIG. 7.

As shown in FIG. 8, when the insert 130 is fastened to the end cap 80", an end cap assembly 136 is formed, which is pressed onto both knurled ends 74" of the shaft 66" as previously described to assemble the agitator assembly 34". Likewise, prior to pushing the end cap assembly 136 onto the shaft 66", the tab portion 98" must first be aligned with the radial slot 62" in the flange 58" on the dowel 44" and then the end cap assembly 136 can be pushed onto the knurled end 74" of the shaft 66".

In operation, the dowel 44" rotates previously described for the first embodiment and the bristle tufts 76" sweep across the cleaning surface and release and propel dust, hair and debris into the working air flow. Over time, the hair and debris accumulates on the dowel 44" and can eventually migrate towards the ends of the agitator assembly 34". Eventually, the hair and debris interferes with the insert 130 and more specifically, with the tab portion 98" of the hair blocking rib 94", which blocks the hair and debris and prevents passage through the labyrinth 116" defined between the insert 130, dowel 44" and flange 58", thereby protecting the bearing 70" from hair and debris ingress. In the third embodiment, the first barrier wall 56" and the labyrinth 116" also provides obstructions to the migration of hair and debris as described above for the first embodiment.

While the invention has been specifically described in connection with certain specific embodiments thereof, it is to be understood that this is by way of illustration and not of limitation, and the scope of the appended claims should be construed as broadly as the prior art will permit.

What is claimed is:

1. A vacuum cleaner comprising:

a housing having a suction nozzle;

a suction source in fluid communication with the suction nozzle; and an agitator assembly mounted in the housing and having an axis, the agitator assembly comprising:

a dowel provided with a plurality of bristles and having at least one end defining a bearing cavity and comprising a flange having a slot, wherein the dowel is rotatable about the axis;

a shaft along the axis;

an end cap received on the shaft to overlie the bearing cavity and forming at least one gap relative to the at least one end; and a hair blocking rib extending from the end cap and inhibiting the migration of hair through the at least one gap and into the bearing cavity;

wherein the hair blocking rib comprises a tab portion located inwardly of the slot and extending radially inwardly adjacent to the flange to inhibit the migration of hair through the at least one gap.

2. The vacuum cleaner from claim 1, wherein the hair blocking rib is spaced from the dowel to permit the rotation of the dowel relative to the hair blocking rib.

3. The vacuum cleaner from claim 1, wherein the hair blocking rib comprises at least one cutting blade for cutting hair on the dowel.

4. A vacuum cleaner comprising:

a housing having a suction nozzle;

a suction source in fluid communication with the suction nozzle; and an agitator assembly mounted in the housing and having an axis, the agitator assembly comprising:

a rotatable dowel provided with a plurality of bristles and having at least one end defining a bearing cavity and comprising a flange protruding radially outwardly from the at least one end, wherein the dowel is rotatable about the axis;

a shaft along the axis;

an end cap fixedly mounted to the housing and received on the shaft to overlie the bearing cavity and forming at least one gap relative to the at least one end; and a stationary hair blocking rib fixed to the end cap and inhibiting the migration of hair through the at least one gap and into the bearing cavity, the hair blocking rib extending from the end cap and past the flange, and comprising at least one cutting blade positioned inwardly of the flange for cutting hair on the dowel as the dowel rotates relative to the stationary hair blocking rib.

5. The vacuum cleaner from claim 4 and further comprising a bearing holder provided in the bearing cavity and a bearing received in the bearing holder, wherein the hair blocking rib inhibits the migration of hair through the at least one gap and into the bearing holder.

6. The vacuum cleaner from claim 4, wherein the flange has a slot sized to allow the hair blocking rib to pass therethrough during assembly of the end cap on the shaft.

7. The vacuum cleaner from claim 6, wherein the hair blocking rib comprises a tab portion located inwardly of the slot and extending radially inwardly adjacent to the flange to inhibit the migration of hair through the at least one gap.

8. The vacuum cleaner from claim 7, wherein the at least one cutting blade is provided on the tab portion.

9. The vacuum cleaner from claim 6, wherein the hair blocking rib is spaced from the flange to form a labyrinth leading to the at least one gap.

10. The vacuum cleaner from claim 9, wherein the hair blocking rib comprises an insert fastened to the end cap.

11. The vacuum cleaner from claim 4, wherein the end cap comprises an end wall and a rim on the periphery of the end wall, and the hair blocking rib extends from the rim.

12. The vacuum cleaner from claim 4, wherein the hair blocking rib comprises an L-shaped member having a support portion extending from the end cap and a tab portion extending from the support portion toward the axis.

13. The vacuum cleaner from claim 12, wherein the tab portion overlies the at least one gap.

14. The vacuum cleaner from claim 4, wherein the dowel comprises a barrier located inwardly of the hair blocking rib that is configured to obstruct hair from migrating along the dowel towards the at least one gap.

15. The vacuum cleaner from claim 4, wherein the at least one gap comprises multiple gaps forming a labyrinth between the dowel and the end cap, wherein the hair blocking rib inhibits the migration of hair through the labyrinth and into the bearing cavity.

16. The vacuum cleaner from claim 4, wherein the hair blocking rib comprises a front face and a rear face which are substantially parallel to the axis, and the at least one cutting blade comprises a sharp edge on each of the front and rear faces for cutting hair on the dowel regardless of the direction of rotation about the axis.

17. The vacuum cleaner from claim 4, wherein the hair blocking rib comprises an insert fastened to the end cap.

18. The vacuum cleaner from claim 17, wherein the insert is one of inserted molded with, heat staked to, ultrasonically welded to, or adhered to the end cap.

19. The vacuum cleaner from claim 17, wherein the insert is made from metal and the end cap is made from plastic.

20. The vacuum cleaner from claim 4 and further comprising a motor coupled to the agitator assembly for rotation of the dowel about the axis.

* * * * *